US005913485A

United States Patent [19]

Bruffett

[11] Patent Number: 5,913,485

[45] Date of Patent: Jun. 22, 1999

[54] DEVICE FOR HOLDING A PLURALITY OF SPOOLS OF THREAD AND FEEDING A SELECTED THREAD ONTO AN ADJACENT SEWING MACHINE

[76] Inventor: Virginia Bruffett, 420 E. 100th 527#, Thornton, Colo. 80229

[21] Appl. No.: 08/929,522

[22] Filed: Sep. 15, 1997

[51] Int. Cl.[6] ..... B65H 49/18; B65H 57/00; A41H 31/00

[52] U.S. Cl. ..... 242/139; D3/25; 112/302; 223/106; 242/157 R

[58] Field of Search ..... 242/139, 140, 242/131, 157 R, 128; D3/25; 112/302; 223/106

[56] References Cited

U.S. PATENT DOCUMENTS

| | | | |
|---|---|---|---|
| D. 244,408 | 5/1977 | Jennings | 242/139 X |
| 464,623 | 12/1891 | Lewy | 242/139 X |
| 669,791 | 3/1901 | Hergst | 242/139 |
| 1,367,685 | 2/1921 | Cohn | 242/139 |
| 1,470,258 | 10/1923 | Ehrlich | 242/139 |
| 1,893,419 | 1/1933 | Kurlzer | 242/139 |
| 3,309,040 | 3/1967 | Stancil | 242/139 |
| 4,367,852 | 1/1983 | Lazaro, Jr. | 242/131 X |

*Primary Examiner*—Michael Mansen
*Attorney, Agent, or Firm*—Edwin H. Crabtree; Ramon L. Pizarro; Donald W. Margolis

[57] ABSTRACT

A spool holder and threading device for holding one or more spools of thread thereon and feeding thread to an adjacent sewing machine. The device provides for convenient storage of a plurality of spools of thread and bobbins next to the sewing machine. The holder and threading device allows for a quick change of different colors of thread. The device includes a horizontal platform adapted for receipt on a sewing table or the like. An upright "Y" shaped spindle support is mounted vertically on the platform. A front profile of the spindle support is similar to a profile of a standard sewing machine. The "Y" shaped spindle support includes base with an elongated first support arm and a shorter second support arm. The support arms extend outwardly and horizontally from the base with the ends of the support arms extending upwardly and vertically. The elongated first support arm allows for sewn material to pass thereunder without restriction during the sewing operation. A rotatable spindle with spindle shaft is removably mounted on the ends of the support arms. The spindle includes a plurality of dowels along the length thereof for receiving spools of threads thereon. A removable thread guide is mounted on the spindle shaft and one of the dowels and positioned next to a selected spool of thread. The thread guide includes an eye therethrough for receiving thread from the selected spool of thread and guiding the thread to the adjacent sewing machine.

12 Claims, 1 Drawing Sheet

DEVICE FOR HOLDING A PLURALITY OF SPOOLS OF THREAD AND FEEDING A SELECTED THREAD ONTO AN ADJACENT SEWING MACHINE

BACKGROUND OF THE INVENTION (a) Field of the Invention

This invention relates to sewing machine accessories and more particularly, but not by way of limitation, to a spool holder and threading device for holding a plurality of spools of thread behind a sewing machine and feeding one or more selected colors of thread to the sewing machine.

(b) Discussion of Prior Art

Heretofore, there have been a variety of different types of threaded spool and bobbin storage devices. In U.S. Pat. No. 4,088,380 to Watts, a storage case is disclosed for existing sewing machines. The storage case is used for holding spools of thread and bobbins. In U.S. Pat. No. 4,757,956 to McGuire, a collapsible spool holder is described having walls that telescope upwardly for holding a plurality of spools of thread thereon. In U.S. Pat. No. 4,129,216 to Schick, a display stand is described for holding spools and sewing accessories. In U.S. Pat. Des. 290,906 to Lux, a new design of a cabinet for spools of sewing thread is illustrated. Also, in U.S. Pat. Des. 338,554 to Davey and Des. 337,431 to Tong, a thread organizer and a sewing thread holder are illustrated.

None of the above mentioned patents provide the unique combination of structure and function of the subject spool holder and threading device for holding one or more spools of thread adjacent a sewing machine and feeding thread to the sewing machine with the objects and advantages as described herein.

SUMMARY OF THE INVENTION

In view of the foregoing, it is a primary object of the present invention to provide a spool holder for holding one or more spools of thread thereon and feeding thread to an adjacent sewing machine.

Another object of the invention is to provide for convenient storage of a plurality of spools of thread and bobbins next to the sewing machine along with other sewing notions.

Yet another object of the spool holder and threading device to allow for a quick change of different colors of thread to the sewing machine without the sewing machine operator having to leave his or her seat next to the sewing machine.

Still another object of the invention is the device has a front profile similar to a profile of a standard sewing machine which allows for sewn material to pass thereunder without restriction during the sewing operation.

A further object of the threading device is the use of a thread guide with an eye therethrough for receiving thread from the selected spool of thread and guiding the thread to the adjacent sewing machine. Also the thread guide may include a pair of eyes therethrough for receiving thread from a pair of selected spools of thread and guiding the threads to the sewing machine when sewing with a double needle for decorative stitching.

The spool holder and threading device includes a horizontal platform adapted for receipt on a sewing table or the like. An upright "Y" shaped spindle support is mounted vertically on the platform. The "Y" shaped spindle support includes a base with an elongated first support arm and a shorter second support arm. The support arms extend outwardly and horizontally from the base with the ends of the support arms extending upwardly and vertically. The elongated first support arm allows for sewn material to pass thereunder without restriction during the sewing operation. A rotatable spindle with spindle shaft is removably mounted on the ends of the support arms. The spindle includes a plurality of dowels along the length thereof for receiving spools of threads thereon. A removable thread guide is mounted on the spindle shaft and one of the dowels and positioned next to a selected spool of thread. The thread guide includes an eye therethrough for receiving thread from the selected spool of thread and guiding the thread to the adjacent sewing machine.

These and other objects of the present invention will become apparent to those familiar with sewing machine accessories from the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
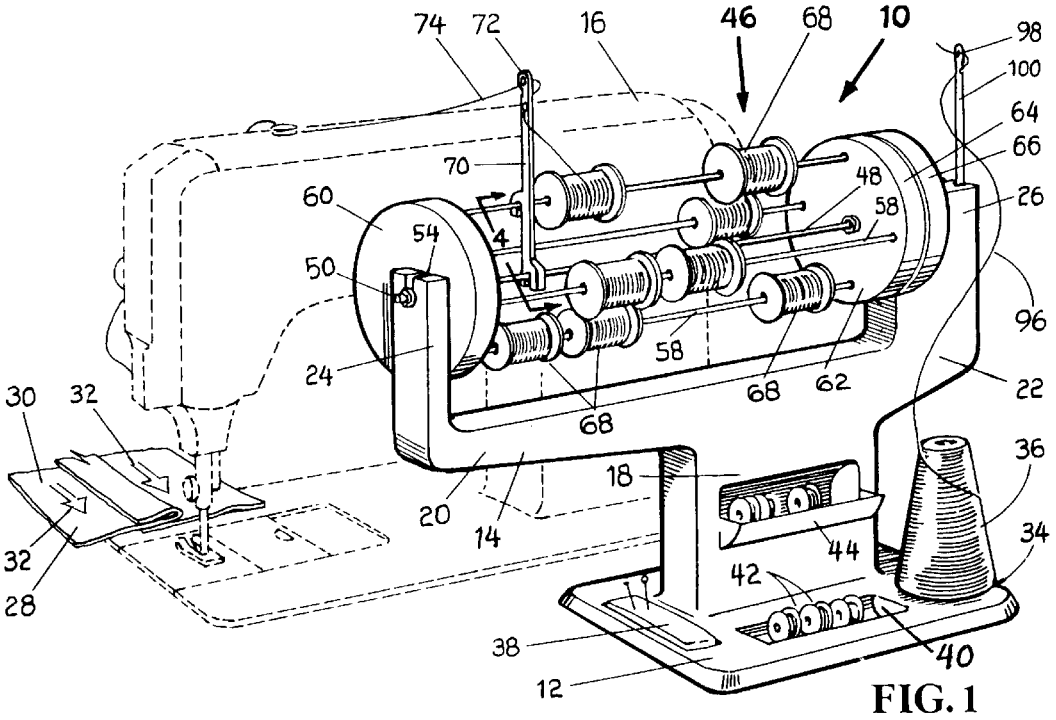
FIG. 1 is a perspective view of the subject spool holder and threading device and positioned next to and back of a standard sewing machine. The sewing machine is shown in dotted lines.

In FIG. 1, a perspective view of the subject spool holder and threading device is shown and having a general reference numeral 10. The device 10 broadly includes a horizontal platform 12 adapted for receipt on a sewing table or the like. The sewing table is not shown in the drawings. An upright "Y" shaped spindle support 14 is mounted vertically on the platform 12. A front profile of the spindle support 14 is similar to a profile of a standard sewing machine 16. The sewing machine 16 is shown in dotted lines and is for illustrative purposes only and forms no part of the invention as described herein.

The "Y" shaped spindle support 14 includes a base 18 with an elongated first support arm 20 and a shorter second support arm 22. The first and second support arms 20 and 22 extend outwardly and horizontally from the base 18 with first end 24 and second end 26 of the support arms 20 and 22 extending upwardly and vertically. The elongated first support arm 20 allows for sewn material to pass thereunder without restriction during the sewing operation. In this drawing, two pieces of material 28 and 30 are shown advancing, as indicated by arrows 32, to be sewn by the sewing machine 16. When the sewing operation is complete and the material 28 and 30 is sewn together, the sewn material is free to pass under the first support arm 20 unencumbered.

The horizontal platform 12 can be used for mounting a cone base 34 for holding a cone 36 of thread thereon, for holding a pin cushion 38 and having a tray 40 cut into the top of the platform 12 for holding bobbins 42 therein. Also, the base 18 of the spindle support 14 can be used for holding a tray 44 of bobbins 42. The tray 40 and tray 44 are shown in FIG. 1 for ease in viewing and are typically mounted on the opposite side of the platform 12 and base 18 so that the bobbins 42 can be easily reached by the operator of the sewing machine 16.

On the opposite side of the base 18, a pair of scissors, a measuring tape and a marking pencil can be stored thereon. The opposite side of the base 18 is not shown in the drawings. Obviously, a variety of sewing notions can be held on the platform 12 and on the base 18 without departing from the spirit and scope of the subject invention.

A key feature of the subject spool holder and threading device 10 is a rotatably spindle having a general reference numeral 46. The spindle 46 includes a spindle shaft 48 having opposite ends 50 and 52 removable mounted and rotatable in slots 54 and 56 in the top of the first end 24 and second end 26 of the support arms 20 and 22. The spindle 46 also includes a plurality of dowels 58 equally spaced around a first spindle disk 60 and a second spindle disk 62. The second spindle disk 62 includes a fixed member 64 and a movable member 66. The dowels 58 are used for receiving a plurality of spools 68 of threads thereon. In the drawings, the spindle 46 is shown with four dowels 58 positioned at 3 o'clock, 6 o'clock, 9 o'clock and 12 o'clock on the spindles disks 60 and 62. It should be kept in mind that any number of dowels 58 may be mounted on the spindle 46 for holding any number of spools 68 of thread.

A removable thread guide 70 is mounted on the spindle shaft 48 and one of the dowels 58. The thread guide 70 is positioned next to a selected spool of thread 68. The thread guide 70 includes an eye 72 therethrough for receiving thread 74 from the selected spool of thread 68 and guiding the thread 74 to the adjacent sewing machine 16.

Figure 2:
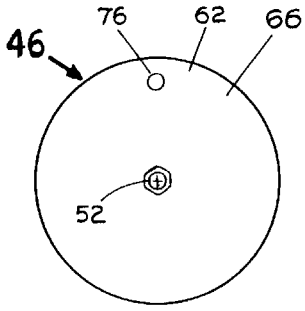
FIG. 2 is an end view of the invention's rotatable spindle with spindle shaft. The spindle is used for holding one or more spools of thread thereon.
Figure 3:
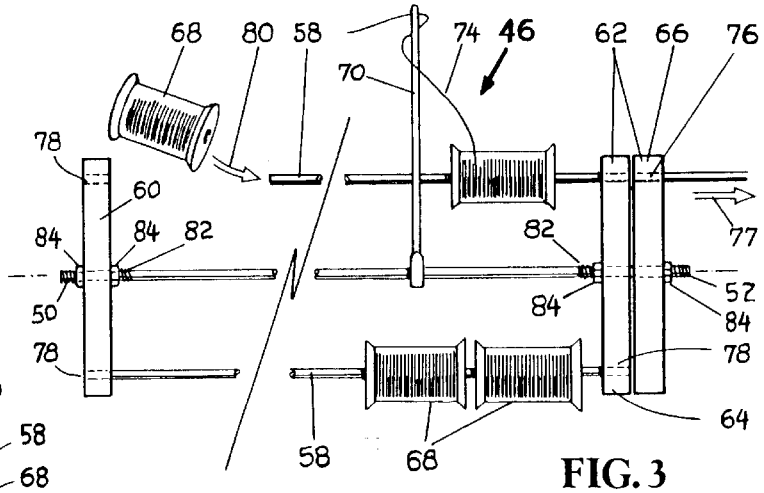
FIG. 3 is a front view of the rotatable spindle shaft with one of the spindle's dowels removed from a spindle disk for removing or adding a threaded spool to the spindle.

In FIG. 2, an end view of the second spindle disk 62 is shown with the movable member 66 having a hole 76 therein for receiving a portion of a selected dowel 58 therethrough as shown in FIG. 3. The movable member 66 is rotated on the end 52 of the spindle shaft 48 until the hole 76 is indexed with one end of the dowels 58 which are mounted in the fixed member 64 of the second spindle disk 62.

In FIG. 3, an upper dowel 58 is shown moved to the right, as indicated by arrow 77, outwardly and through the hole 76. It should be noted, that all of the dowels 58 are mounted in holes 78 in the first and second spindle disks 60 and 62 in a loose press fit. The holes 78 are shown in dotted lines. In this manner, each dowel 58 can be indexed with the hole 76 in the moveable member 66 and moved through the hole 76 for either removing spools 68 or adding spools 68 onto the length of a selected dowel 58. In FIG. 3, a spool 68 is shown being added to the upper dowel 58 as indicated by arrow 80.

Also, it should be mentioned that the dowel 58 in a 3 o'clock position as shown in FIG. 1 has been removed in FIG. 3, so the spindle shaft 48 can be seen more clearly. The spindle shaft 48 includes shaft threads 82 at opposite ends 50 and 52 for securing threaded nuts 84 on opposite sides of the first and second spindle disks 60 and 62. The nuts 84 are used for holding the spindle disks 60 and 62 in place on the spindle shaft 48.

The holes through the center of in each spool 68 of thread have a diameter larger than the diameter of the dowels 58. Therefore, when the spools 68 are mounted on the dowels 58 they can freely rotate thereon and feed thread 74 without restriction through the eye 72 in the thread guide 74.

Figure 4:
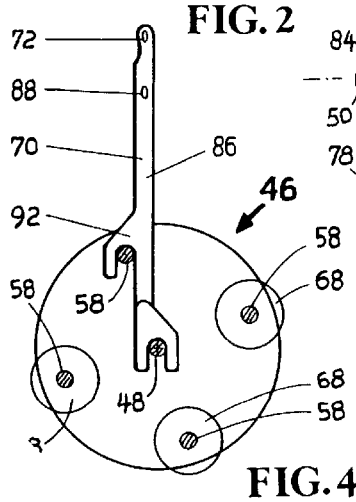
FIG. 4 is a cross sectional view of the spindle taken along lines 4—4 shown in FIG. 1. In this illustration, a front view of a removable thread guide is shown mounted on the spindle shaft and one of the spindle dowels.

In FIG. 4, a cross section of the spindle 46 is shown taken along lines 4—4 shown in FIG. 1. In this view, a front view of the thread guide 70 is shown. The thread guide 70 includes a vertical arm 86 with the eye 72 in the top thereof. Also, a second eye 88 may be included in the arm 86 for threading a second thread therethrough with the sewing machine operator is doing double needle sewing for decorative stitching. The bottom of the vertical arm 86 includes a first hook arm 92 disposed above a second hook arm 94. The first hook arm 92 is dimensioned for receipt around a portion of one of the dowels 58 in a press fit. The second hook arm 94 is dimensioned for receipt around a portion of the spindle shaft 48. When the bottom of the vertical arm 86 of the thread guide 70 is pressed on top of the spindle shaft 48 and the dowel 58 as shown if FIGS. 1, 3 and 4, the thread guide 70 is held firmly in place as thread 74 is feed continuously through the eye 72 or both of the eyes 72 and 88 during the sewing operation. The holding of the thread guide 70 in place next to a selected spool of thread 68 is important since there is a certain amount of vibration during the sewing operation which might tend to vibrate the thread guide loose from the spindle 46.

OPERATION OF THE INVENTION

In operation, the unique spool holder and threading device 10 is placed behind the sewing machine 16 as shown in FIG. 1. A selected spool 68 of thread is chosen and the spool 68 is rotated on the spindle 46 into a 12 o'clock position or close to a 12 o'clock position. At this time, the thread guide 70 is place next to the selected spool 46 with the hook arms 92 and 94 secured to the spindle shaft 48 and the dowel 58. The selected thread 74 is then threaded through the eye 72 and then to the top of the adjacent sewing machine 16 for attachment to the needle feed on the sewing machine. As the sewing operation begins, the materials 28 and 30 are feed through the sewing machine 16 and sewed together using the thread 74. As mentioned above, if a double sewing operation is required, two threads are feed through the eyes 72 and 88 of the thread guide 70 and to the sewing machine 16. When the sewn material 28 and 30 is feed through the sewing machine 16, by the nature of the front profile of the device 10, the material is free to pass under the first support arm 20 without restriction. Should the operator of the sewing machine need to change color of thread, she or he can quickly cut the thread currently used and rewind the remaining thread back onto the spool 68. The operator, without leaving her or his seat, can then select a new color of thread and rotate the spool into a 12 o'clock position and place the thread guide 70 next to the newly selected spool 68. The new color of thread is then threaded through the eye 72 of the thread guide 70 and then to the sewing machine 16 for threading into the machine's sewing needle.

When the operator of the sewing machine is sewing quilts and items that require a great amount of thread, the cone 36 of thread can be used with thread 96 received through an eye 98 in the top of a cone thread guide 100. The bottom of the cone thread guide 100 is mounted in the top of the second end 26 of the spindle support 14. The cone thread guide 100 acts in the same manner as the thread guide 70 in guiding thread onto the sewing machine 16.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A spool holder and threading device for receipt on a sewing table and the like, the device used for holding a spool of thread thereon and feeding thread from the spool to an adjacent sewing machine, the device comprising:

a horizontal platform adapted for receipt on the sewing table;

a spindle support, said spindle support mounted vertically on said platform, said spindle support including a base with a first support arm and a second support arm, said first and second support arms extending outwardly and horizontally from said base with ends of said first and said second support arms extending upwardly and vertically;

a spindle, said spindle including a first and a second spindle disk, a spindle shaft and a dowel, said spindle shaft having opposite ends mounted on said first and said second spindle disk, said dowel having opposite ends mounted on said first and said second spindle disk, the opposite ends of said spindle shaft rotatably mounted on the ends of said first and said second support arms, said dowel adapted for receiving the spool of thread thereon; and a thread guide having an eye therethrough for receiving the thread from the spool of thread, said thread guide having hook arms for releasably mounting on said spindle shaft and on said dowel.

2. The device as described in claim 1 to wherein said spindle includes a plurality of dowels mounted horizontally on said first and said second spindle disks, said dowels adapted for receiving a plurality of spools of thread thereon.

3. The device as described in claim 2 wherein said dowels are releasably mounted on said first and said second spindle disks for removing and adding to the plurality of spools of thread received thereon.

4. The device as described in claim 1 wherein said first support arm is elongated and said second support arm is shorter than said elongated first support arm and wherein said spindle support provides a front profile similar to a front profile of a standard sewing machine for receiving sewn material thereunder.

5. A spool holder and threading device for receipt on a sewing table and the like, the device used for holding spools of thread thereon and feeding thread from the spools to an adjacent sewing machine, the device comprising:

a horizontal platform adapted for receipt on the sewing table;

a "Y" shaped spindle support, said spindle support mounted vertically on said platform, said spindle support including a base with a first support arm and a second support arm, said first and second support arms extending outwardly and horizontally from said base with ends of said first and said second support arms extending upwardly and vertically;

a spindle, said spindle including a first and a second spindle disk, a spindle shaft and a plurality of dowels, said spindle shaft having opposite ends mounted on said first and said second spindle disk and extending outwardly therefrom, said dowels having opposite ends mounted on said first and said second spindle disk, the opposite ends of said spindle shaft rotatably mounted on the ends of said first and said second support arms; said dowels adapted for receiving the spools of thread thereon; and a thread guide having an eye therethrough for receiving thread from one of the spools of thread, said thread guide having hook arms for releasably mounting on said spindle shaft and on one of said dowels.

6. The device as described in claim 5 wherein said dowels are releasably mounted on said first and said second spindle disks for removing and adding the spools of thread received thereon.

7. The device as described in claim 5 wherein said first support arm is elongated and said second support arm is shorter than said elongated first support arm and wherein said "Y" shaped spindle support provides a front profile similar to a front profile of a standard sewing machine for receiving sewn material thereunder.

8. The device as described in claim 5 wherein said thread guide includes a pair of eyes therethrough for receiving thread from the spools of thread.

9. A spool holder and threading device for receipt on a sewing table and the like, the device used for holding spools of thread thereon and feeding thread from the spools to an adjacent sewing machine, the device comprising:

a horizontal platform adapted for receipt on the sewing table;

a "Y" shaped spindle support, said spindle support mounted vertically on said platform, said spindle support including a base with a first support arm and a second support arm, said first and second support arms extending outwardly and horizontally from said base with ends of said first and said second support arms extending upwardly and vertically, wherein said first support arm is elongated and said second support arm is shorter than said elongated first support arm and wherein said "Y" shaped spindle support provides a front profile similar to a front profile of a standard sewing machine for receiving sewn material thereunder; and a spindle, said spindle including a first and a second spindle disk, a spindle shaft and a plurality of dowels, said spindle shaft having opposite ends mounted on said first and said second spindle disk and extending outwardly therefrom, said dowels having opposite ends mounted on said first and said second spindle disk, the opposite ends of said spindle shaft rotatably mounted on the ends of said first and said second support arms, said dowels adapted for receiving the spools of thread thereon.

10. The device as described in claim 9 further including a thread guide having an eye therethrough for receiving thread from one of the spools of thread, said thread guide having hook arms for releasably mounting on said spindle shaft and on one of said dowels.

11. The device as de scribed in claim 10 wherein said thread guide includes a pair of eyes therethrough for receiving thread from the spools of thread.

12. The device as described in claim 9 wherein said dowels are releasably mounted on said first and said second spindle disks for removing and adding the spools of thread received thereon.

* * * * *